US006962490B2

(12) United States Patent
Garden

(10) Patent No.: US 6,962,490 B2
(45) Date of Patent: Nov. 8, 2005

(54) CONCRETE EXTRUDER ATTACHMENT FOR A VEHICLE

(76) Inventor: Norman John Garden, Box 923, Millet, Alberta (CA), T0C 1Z0

( * ) Notice: Subject to any disclaimer, the term of this patent is extended or adjusted under 35 U.S.C. 154(b) by 12 days.

(21) Appl. No.: 10/691,842

(22) Filed: Oct. 23, 2003

(65) Prior Publication Data

US 2005/0048150 A1 Mar. 3, 2005

(30) Foreign Application Priority Data

Aug. 27, 2003 (CA) ..... 2438567

(51) Int. Cl.[7] ..... E01C 19/52

(52) U.S. Cl. ..... 425/64; 425/65; 404/98; 404/105

(58) Field of Search ..... 425/63, 64, 65; 249/3; 404/98, 105

(56) References Cited

U.S. PATENT DOCUMENTS

| | | | | |
|---|---|---|---|---|
| 3,600,773 A | * | 8/1971 | Davis et al. | 425/63 |
| 3,920,349 A | * | 11/1975 | Jennings et al. | 404/98 |
| 4,298,293 A | * | 11/1981 | Baucom | 404/98 |
| 4,391,549 A | | 7/1983 | Murray | 404/87 |
| 4,789,266 A | * | 12/1988 | Clarke et al. | 404/96 |
| 5,018,955 A | | 5/1991 | Parrish et al. | 425/64 |
| 5,173,005 A | | 12/1992 | Henderson et al. | 404/98 |
| 5,527,129 A | | 6/1996 | McKinnon | 404/98 |
| 5,662,431 A | | 9/1997 | Colvard | 404/105 |
| 5,993,108 A | | 11/1999 | Buhman | 404/88 |
| 5,997,270 A | | 12/1999 | LaBonte | 425/64 |
| 6,450,730 B1 | | 9/2002 | Matthias et al. | 404/98 |
| 6,508,606 B1 | | 1/2003 | James, III et al. | 404/98 |

FOREIGN PATENT DOCUMENTS

| | | | |
|---|---|---|---|
| FR | 2297703 | 9/1976 | B28B/15/00 |
| WO | WO96/36467 | 5/1996 | B28B/13/02 |

* cited by examiner

*Primary Examiner*—Donald Heckenberg
(74) *Attorney, Agent, or Firm*—Christensen O'Connor Johnson Kindness PLLC

(57) ABSTRACT

A concrete extruder attachment for a vehicle includes a hopper adapted to hold flowable concrete. The hopper has an upper concrete inlet and a lower concrete outlet. A slip form is connected to the lower concrete outlet. An internal vibrator causes concrete to flow from the hopper through the lower concrete outlet to the form. A mounting is provided which is adapted to mount to a vehicle. A hopper support is secured to the hopper. The hopper support is pivotally mounted to the mounting for pivotal movement between a first position with the hopper extending toward a first side of the vehicle and a second position with the hopper extending toward a second side of the vehicle. The support is selectively locked in one of the first position or the second position. The ability to pivot the hopper enables the concrete extruder to access corners.

3 Claims, 4 Drawing Sheets

CONCRETE EXTRUDER ATTACHMENT FOR A VEHICLE

FIELD OF THE INVENTION

The present invention relates to a concrete extruder attachment for a vehicle and, in particular, one which may be used for forming curbs along roads and in parking areas.

BACKGROUND OF THE INVENTION

U.S. Pat. No. 5,173,005 (Henderson et al 1992) is an example of a concrete extruder attachment for a front end loader of a tractor. The Henderson et al concrete extruder is no longer commercially available, as it was found to be too complex of a machine to gain commercial acceptance. A particular problem with the Henderson et al machine was that it could not be used to complete corner areas. Any areas that the Henderson et al machine could not access, had to be completed through hand forming.

SUMMARY OF THE INVENTION

What is required is a simple concrete extruder which can more easily access corner areas.

According to the present invention there is provided a concrete extruder attachment for a vehicle which includes a hopper adapted to hold flowable concrete. The hopper has an upper concrete inlet and a lower concrete outlet. A slip form is connected to the lower concrete outlet. Means is provided for causing concrete to flow from the hopper through the lower concrete outlet to the slip form. A mounting adapted to mount to a vehicle. A hopper support is secured to the hopper. The hopper support is pivotally mounted to the mounting for pivotal movement between a first position with the hopper extending toward a first side of the vehicle and a second position with the hopper extending toward a second side of the vehicle. Means is provided for selectively locking the support in one of the first position or the second position.

With the concrete extruder attachment, as described above, the hopper can be swung to either the first side or the second side of the vehicle to provide better access to corner areas.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
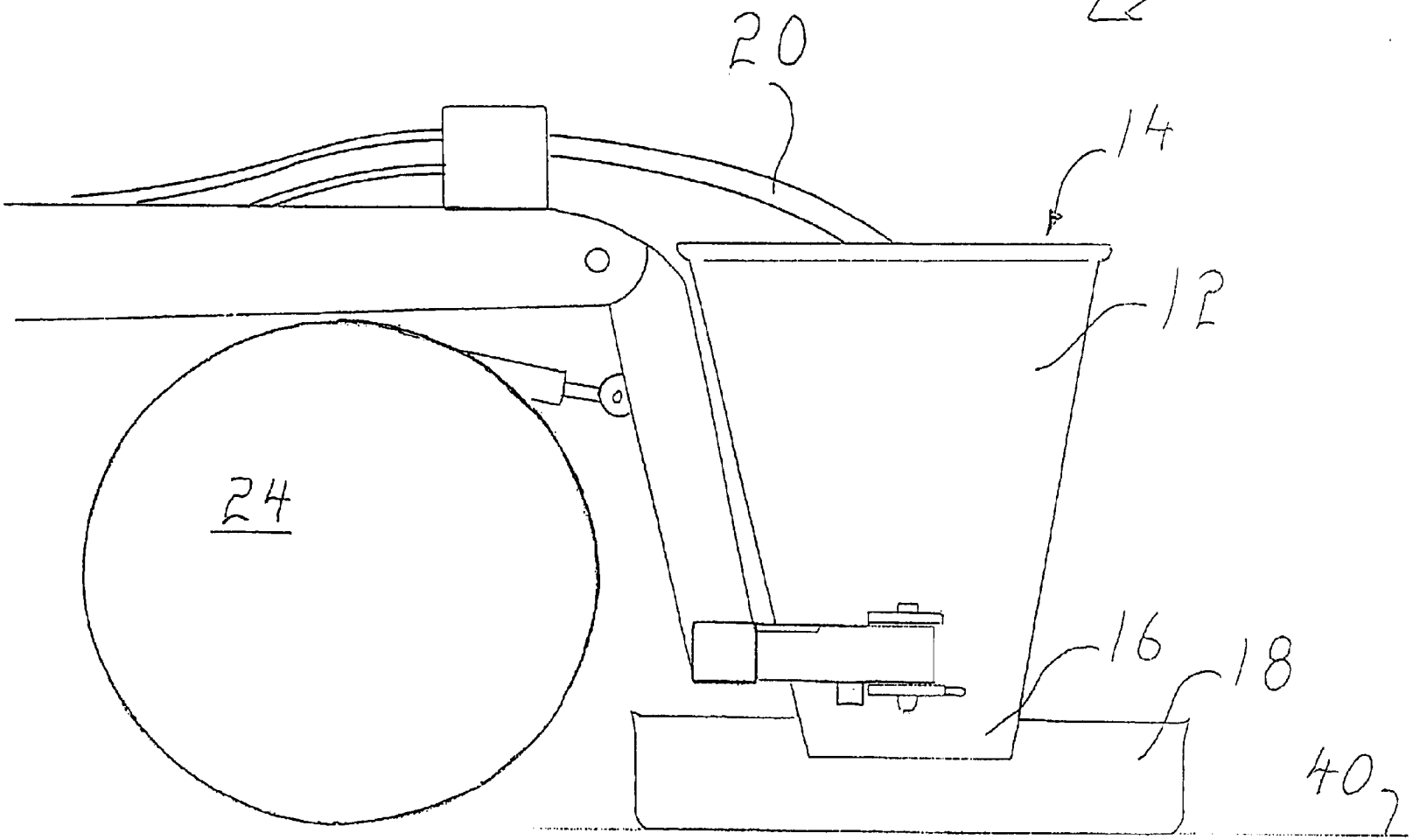
FIG. 1 is a side elevation view of a concrete extruder attachment for a vehicle constructed in accordance with the teachings of the present invention.

The preferred embodiment, a concrete extruder attachment for a vehicle generally identified by reference numeral 10, will now be described with reference to FIGS. 1 through 4.

Figure 2:
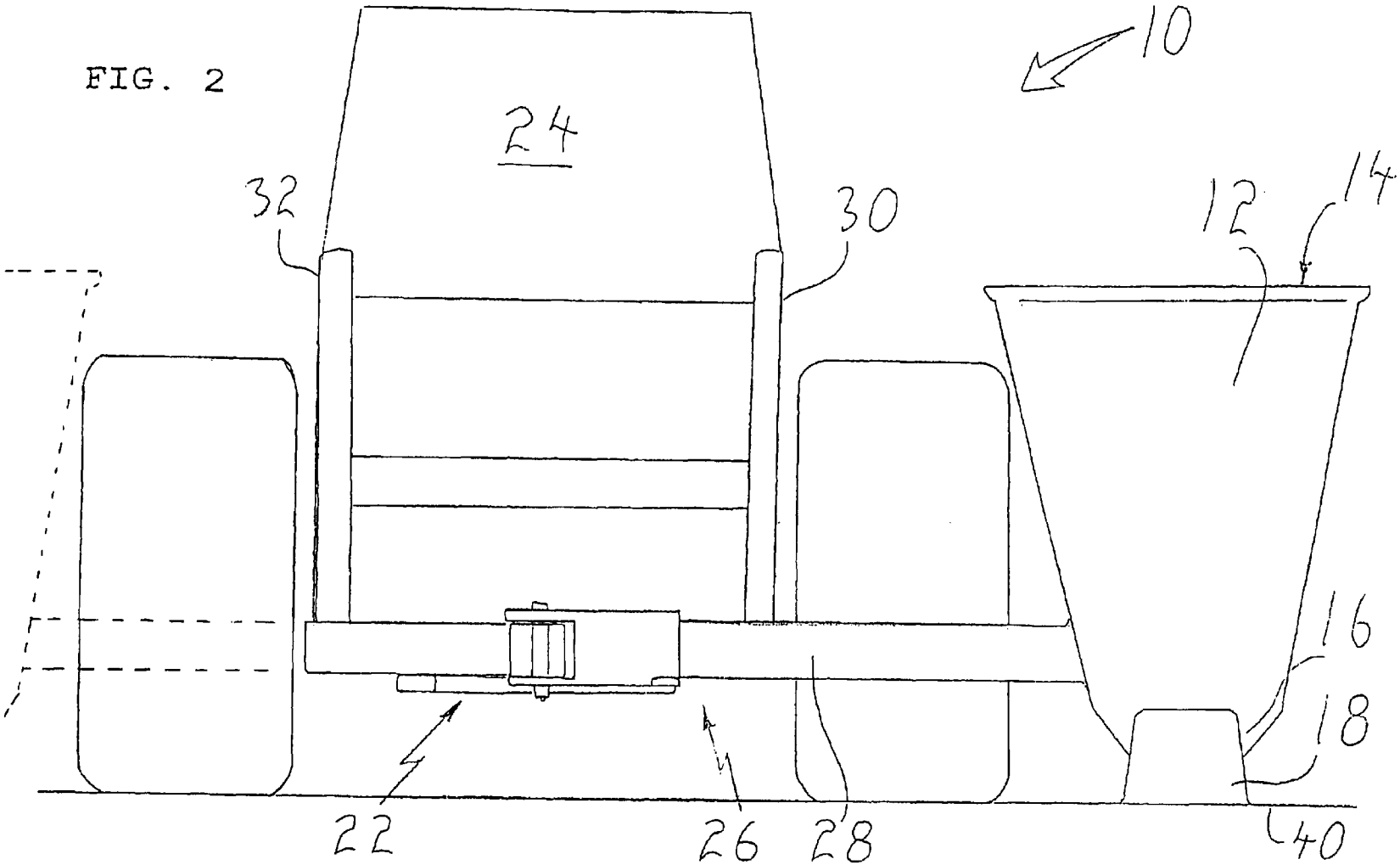
FIG. 2 is a front elevation view of the concrete extruder attachment for a vehicle illustrated in FIG. 1.
Figure 3:
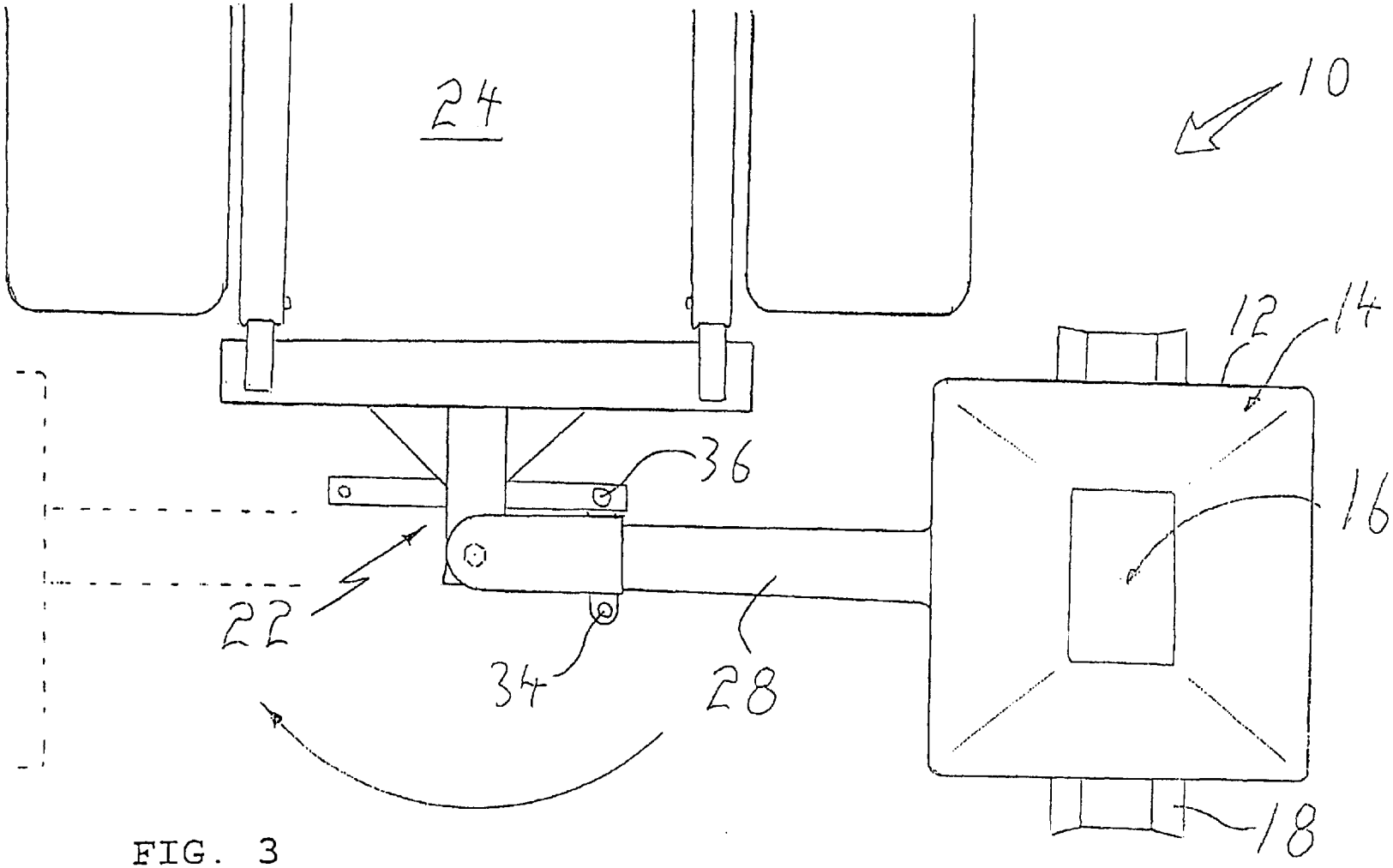
FIG. 3 is a top plan view of the concrete extruder attachment for a vehicle illustrated in FIG. 1.
Figure 4:
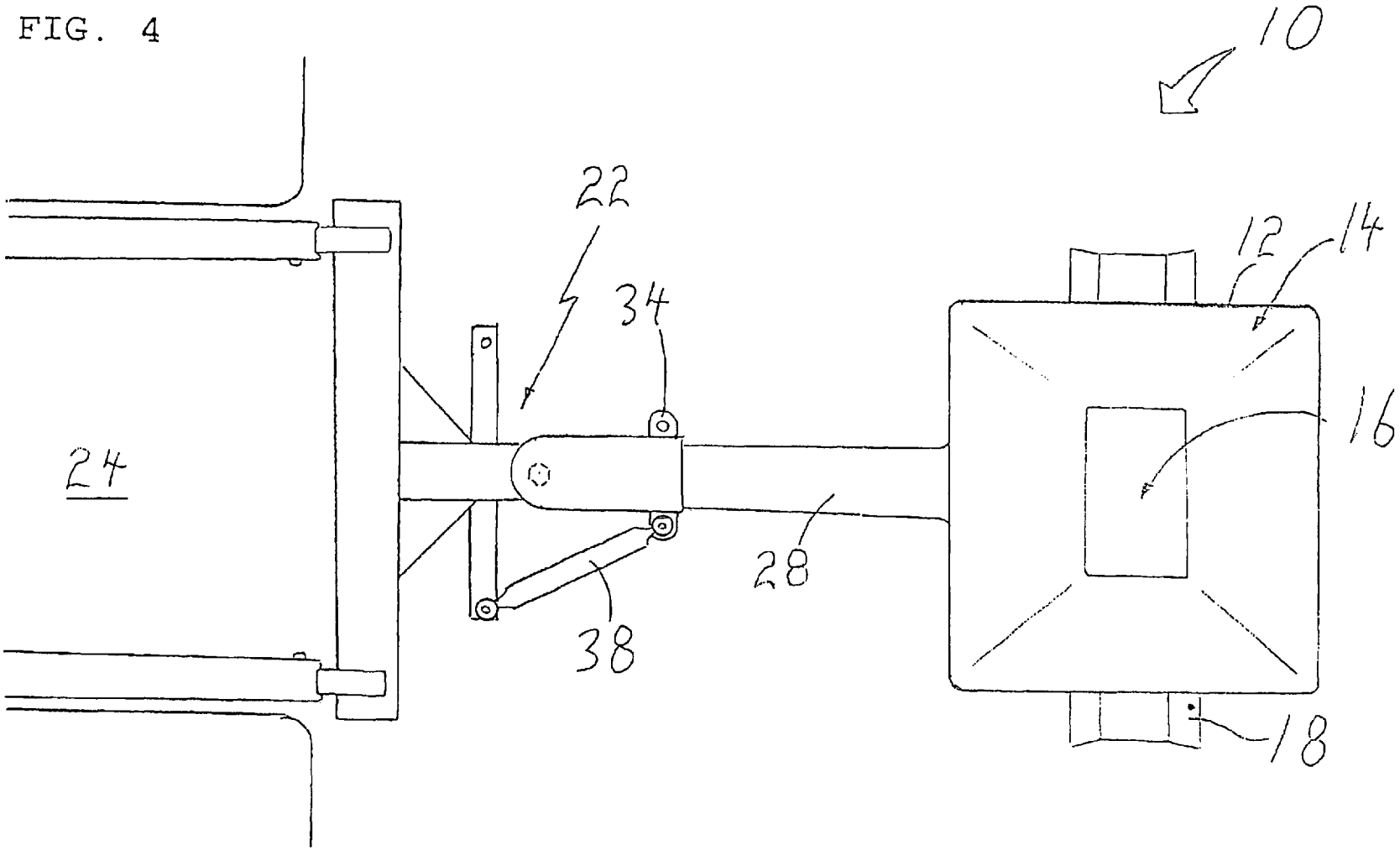
FIG. 4 is a top plan view of the concrete extruder attachment for a vehicle illustrated in FIG. 1 in transit or storage mode.

Structure and Relationship of Parts:

Referring to FIG. 1, concrete extruder attachment 10 has a hopper 12, adapted to hold flowable concrete. Hopper 12 has an upper concrete inlet 14 and a lower concrete outlet 16. A curb form 18 is connected to lower concrete outlet 16. In the illustrated embodiment, a vibrator 20 is positioned within hopper 12. It will be appreciated that other means for causing concrete to flow from hopper 12 through lower concrete outlet 16 to curb form 18 may be used. Referring to FIG. 2, a mounting 22 is provided adapted to mount to a vehicle 24. A hopper support 26 is secured to hopper 12. In the illustrated embodiment, support 26 is in the form of a support arm 28 which is pivotally mounted to mounting 22 for pivotal movement between a first position with hopper 12 extending toward a first side 30 of vehicle 24 (as shown), and a second position with hopper 12 extending toward a second side 32 of vehicle 24. Referring to FIG. 3, in the illustrated embodiment, opposed locking pin receiving apertures 34 extend from opposed sides of hopper support arm 28. A locking pin 36 is extended through a selected one of locking pin receiving apertures 34 and into engagement with mounting 22 in order to maintain hopper support arm 28 in one of the first position or the second position. It will be appreciated that other means for selectively locking support arm 28 in one of the first position or the second position may be used. Referring to FIG. 4, in the illustrated embodiment, a strut 38 connects support arm 28 to mounting 22, locking hopper support arm 28 in a third, forward position. It will be appreciated that other means for selectively locking support arm 28 in a forward position may be used.

Operation:

The use and operation of concrete extruder attachment for a vehicle 10 will now be described with reference to FIGS. 1 through 4. Referring to FIG. 2, vehicle 24 is adapted with mounting 22. Support arm 28 is pivotally attached to mounting 22. Referring to FIG. 3, one of first position toward first side 30 or second position toward second side 32 of vehicle 24, is selected and locked in place by placing pin 36 into the appropriate receiving aperture 34, engaging mounting 22. Referring to FIG. 1, concrete extruder attachment 10 is positioned such that curb form 18 is substantially aligned with surface 40. Flowable concrete is provided at upper concrete inlet 14 which flows to lower concrete outlet 16 and into curb form 18. Vibrator 20 is inserted into hopper 12 to facilitate the flow of concrete. Referring to FIG. 3, where it is necessary to change sides, for example, where a corner is to be formed, concrete extruder attachment 10 may be switched from first position to second position by removing pin 36, swinging concrete extruder attachment 10 and replacing pin 36 in the opposite aperture 34. Referring to FIG. 4, where extruder attachment 10 needs to be stored or is in transit, strut 38 may be attached, locking support arm 28 in a forward position.

Although the present invention has been demonstrated for use with a curb form. It will be understood that other types of slip form may be used. To this end it is preferred that a quick coupling be used to secure the curb form in position, so that other slip form may be substituted. It will be understood that the word vehicle, when used in this application should be interpreted to include a mobile trailer unit.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A concrete extruder attachment for a vehicle, comprising:

a hopper adapted to hold flowable concrete, the hopper having an upper concrete inlet and a lower concrete outlet;

a slip form connected to the lower concrete outlet;

means for causing concrete to flow from the hopper through the lower concrete outlet to the slip form;

a mounting adapted to rigidly mount to one of a front or a back of a motor vehicle;

a hopper support arm secured to the hopper, the hopper support arm being pivotally mounted to the mounting for pivotal movement about a substantially vertical pivot axis between a first position with the hopper extending toward a first side of the vehicle and a second position with the hopper extending toward a second side of the vehicle;

means for selectively locking the hopper support arm in a selected one of the first position or the second position, such that upon release of the locking means the hopper support arm is free to pivot about the pivot axis and swing in an arc to an other of the first position or the second position.

2. The concrete extruder as defined in claim 1, wherein the means for causing concrete to flow is a vibrator positioned within the hopper.

3. The concrete extruder as defined in claim 1, wherein the means for selectively locking the hopper support in one of the first position or the second position consists solely of opposed locking pin receiving apertures extending from opposed sides of the hopper support arm, such that a locking pin is extended through a selected one of the locking pin receiving apertures and into engagement with the mounting in order to maintain the hopper support arm in one of the first position or the second position.

* * * * *